US011821699B2

(12) United States Patent
Guymon et al.

(10) Patent No.: US 11,821,699 B2
(45) Date of Patent: Nov. 21, 2023

(54) HEAT EXCHANGER HANGER SYSTEM

(71) Applicant: LUMMUS TECHNOLOGY LLC, Bloomfield, NJ (US)

(72) Inventors: David Guymon, Bloomfield, NJ (US); Ron Herbanek, Bloomfield, NJ (US)

(73) Assignee: LUMMUS TECHNOLOGY LLC, Bloomfield, NJ (US)

( * ) Notice: Subject to any disclaimer, the term of this patent is extended or adjusted under 35 U.S.C. 154(b) by 40 days.

(21) Appl. No.: 17/321,265

(22) Filed: May 14, 2021

(65) Prior Publication Data

US 2021/0404752 A1 Dec. 30, 2021

Related U.S. Application Data

(60) Provisional application No. 63/045,721, filed on Jun. 29, 2020.

(51) Int. Cl.
*F28F 9/007* (2006.01)
*F28F 3/08* (2006.01)

(52) U.S. Cl.
CPC ..... *F28F 9/007* (2013.01); *F28F 3/08* (2013.01); *F28F 2265/26* (2013.01); *F28F 2270/02* (2013.01)

(58) Field of Classification Search
CPC ..... F28F 2280/06; F28F 2280/08; F28F 2270/02; F28F 2265/26; F22B 37/205
See application file for complete search history.

(56) References Cited

U.S. PATENT DOCUMENTS 848,044 A * 3/1907 Patrick ..... F22B 37/202 122/510
1,757,343 A * 5/1930 Steinmuller ..... F22B 37/202 122/510
1,961,233 A * 6/1934 Mayr ..... F22B 37/141 122/235.23
2,056,492 A * 10/1936 Stout ..... F28F 13/12 165/68

(Continued)

FOREIGN PATENT DOCUMENTS

CN 105247174 A 1/2016
DE 3441972 A * 5/1986 ..... F22B 37/20

(Continued)

OTHER PUBLICATIONS

Translation of Japanese Patent Document JPH08285206A entitled Translation-JPH08285206A (Year: 2023).*

(Continued)

*Primary Examiner* — Paul Alvare
(74) *Attorney, Agent, or Firm* — Seed IP Law Group LLP

(57) ABSTRACT

A heat exchanger system includes a rigid framework. A first heat exchanger may be coupled to a first support structure on a top of the rigid framework. A second heat exchanger may be positioned below the first heat exchanger. The second heat exchanger may be coupled to a second support structure. The second support structure may hang from the rigid framework via a first set of tethers. The first set of tethers may be configured to vertically and horizontally move the second support structure. The vertically and horizontally movement of the second support structure may be based on a thermal expansion of the second heat exchanger.

23 Claims, 6 Drawing Sheets

(56) References Cited

U.S. PATENT DOCUMENTS

| | | | | | |
|---|---|---|---|---|---|
| 2,204,144 | A * | 6/1940 | Hardgrove | F28F 9/013 | 165/96 |
| 2,876,975 | A * | 3/1959 | Short | F28F 9/0131 | 248/68.1 |
| 2,920,873 | A * | 1/1960 | Schluderberg | F22B 37/202 | 165/162 |
| 2,962,007 | A * | 11/1960 | Koch | F22B 37/202 | 122/510 |
| 3,208,436 | A * | 9/1965 | Godshalk | F22B 37/66 | 122/510 |
| 3,479,994 | A * | 11/1969 | Lavey | F22B 37/208 | 122/494 |
| 3,526,274 | A * | 9/1970 | Gardner | F28F 9/013 | 165/145 |
| 3,814,063 | A * | 6/1974 | Bijmholt | F22B 37/104 | 122/6 A |
| 4,236,574 | A * | 12/1980 | Bosne | F28C 1/14 | 261/153 |
| 4,539,940 | A | 9/1985 | Young | | |
| 5,203,405 | A | 4/1993 | Gentry et al. | | |
| 6,189,608 | B1 * | 2/2001 | Bodas | B60K 11/085 | 165/300 |
| 6,305,330 | B1 * | 10/2001 | Darling | F22B 37/244 | 122/4 D |
| 6,532,745 | B1 | 3/2003 | Neary | | |
| 7,240,640 | B2 * | 7/2007 | Kinnunen | F22B 37/244 | 122/510 |
| 8,272,429 | B2 | 9/2012 | Inatomi et al. | | |
| 8,596,075 | B2 | 12/2013 | Allam et al. | | |
| 8,661,780 | B2 | 3/2014 | Wettstein et al. | | |
| 8,959,887 | B2 | 2/2015 | Allam et al. | | |
| 9,657,604 | B2 | 5/2017 | Sjödin | | |
| 10,018,115 | B2 | 7/2018 | Allam et al. | | |
| 10,422,252 | B2 | 9/2019 | Allam et al. | | |
| 11,073,080 | B2 | 7/2021 | Conlon | | |
| 2012/0023893 | A1 | 2/2012 | Yoo et al. | | |
| 2012/0023947 | A1 | 2/2012 | Kulkarni et al. | | |
| 2016/0053721 | A1 | 2/2016 | Fletcher et al. | | |
| 2018/0073434 | A1 | 3/2018 | Allam et al. | | |
| 2018/0073723 | A1 * | 3/2018 | Lankinen | F22B 1/04 | |
| 2018/0106473 | A1 * | 4/2018 | Shimono | E04G 23/0218 | |
| 2019/0063319 | A1 | 2/2019 | Forrest | | |
| 2021/0087949 | A1 | 3/2021 | Han et al. | | |

FOREIGN PATENT DOCUMENTS

| | | | | |
|---|---|---|---|---|
| EP | 764814 | A1 * | 3/1997 | F22B 37/24 |
| EP | 0990780 | A1 | 4/2000 | |
| EP | 1703041 | A1 * | 9/2006 | F28C 1/02 |
| JP | H-08285206 | A * | 11/1996 | F22B 37/008 |
| JP | 2001304785 | A * | 10/2001 | F28F 9/007 |
| JP | 2003035164 | A | 2/2003 | |
| RU | 179529 | U1 * | 5/2018 | |
| RU | 2690308 | C1 * | 5/2019 | |
| WO | 2007097573 | A1 | 8/2007 | |

OTHER PUBLICATIONS

Translation of German Patent Document DE3441972A entitled Translation-DE3441972A (Year: 2023).*

Shepstone, T., "Turning Natural Gas Into Water: Hydraulic Fracturing Doesn't Deplete Water Supplies," Apr. 2012, URL=https://www.energyindepth.org/turning-natural-gas-into-water-hydraulic-fracturing-doesnt-deplete-water-supplies-2/, 5 pages.

International Search Report issued in International Application No. PCT/US2021/032580 dated Oct. 21, 2021 (5 pages).

Written Opinion issued in International Application No. PCT/US2021/032580 dated Oct. 21, 2021 (7 pages).

* cited by examiner

HEAT EXCHANGER HANGER SYSTEM

BACKGROUND

Thermal power cycles typically use either air breathing gas turbine direct fired Brayton Cycle or indirectly heated closed Rankine Cycle with steam as a working fluid. High efficiencies are obtained by combining the Brayton cycle with a bottoming Rankine Cycle to form a combined cycle. Whilst combined cycle power generation may achieve high efficiency, combined cycle power generation is not suitable for CO2 capture, and the installation can have high capital cost due to the large amount of equipment and pipe work required. In some case, a Supercritical CO2 (SCCO2) Brayton thermal power cycle may be used over the thermal power cycles. Advantageously, Supercritical CO2 (SCCO2) Brayton thermal power cycle may have reduced Greenhouse Gas (GHG) emissions, improved carbon capture, higher efficiency, reduced footprint and lower water consumption. However, there are several technical challenges that must be overcome before the benefits of Supercritical CO2 (SCCO2) Brayton thermal power cycle may be realized. In particular, the design and operation of recuperative heat exchangers for these Supercritical CO2 (SCCO2) Brayton thermal power cycles are an ongoing area of research and development.

A semi-closed direct fired oxy-fuel Brayton cycle may be called an Allam Power Cycle or Allam Cycle. The Allam Cycle is a process for converting fossil fuels into mechanical power, while capturing the generated carbon dioxide and water. Conventionally, the Allam Cycle requires an economizer heat exchanger and an additional low-grade external heat source to achieve high efficiency comparable to existing combined cycle-based technology, with the crucial added benefit of CO2 capture for use or storage. The efficiency of the Allam Cycle is increased if the turbine is operated at higher temperatures typically above 600° C. and at high pressure of 120 to 400 bar. These conditions lead to the simultaneous requirements of high-pressure high temperature and high effectiveness for the heat exchange system. Typically, multiple individual heat exchange units are required, and must be arranged in a network to achieve the required recuperative heat exchange simultaneously with heat recovery from the external low-grade heat source. Example of conventional heat exchanger systems and methods may be found in U.S. Pat. Nos. 8,272,429; 8,596,075; 8,959,887; 10,018,115; 10,422,252; and U.S. Pat. Pub. No. 2019/0063319. All of which are incorporated herein by reference.

Conventionally, heat exchanger systems have a common feature that they are split into high, medium and low temperature sections. Whilst it is desirable to cool the exhaust gas in the high temperature section to the lowest temperature (for instance a temperature coincident with the low grade heat source temperature), this is in conflict with the mechanical requirements that drive the layout, cost and reliability of such a system. Typically, the design temperature and pressure of the high temperature section are set by the highest temperature and pressure which in turn drives the mechanical requirements.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to A heat exchanger system including a rigid framework. A first heat exchanger may be coupled to a first support structure on a top of the rigid framework. A second heat exchanger may be positioned below the first heat exchanger. The second heat exchanger may be coupled to a second support structure, the second support structure hanging from the rigid framework via a first set of tethers, the first set of tethers may be configured to vertically and horizontally move the second support structure. A second set of tethers may be connected to the second support structure and extend downward to hang a support beam. A third set of tethers may be connected to the support beam and extend downward to hang a third support structure, the third set of tethers may be configured to vertically and horizontally move the third support structure. A third heat exchanger may be coupled to the third support structure. The vertically and horizontally movement of the second support structure may be based on a thermal expansion of the second heat exchanger. The vertically and horizontally movement of the third support structure may be based on a thermal expansion of the third heat exchanger.

In another aspect, embodiments disclosed herein relate to a heat exchanger system including a rigid framework a rigid framework. A first heat exchanger may be coupled to a first support structure on a top of the rigid framework. A second heat exchanger may be positioned below the first heat exchanger. The second heat exchanger may be coupled to a second support structure. The second support structure may hang from the rigid framework via a first set of tethers. The first set of tethers may be configured to vertically and horizontally move the second support structure. The vertically and horizontally movement of the second support structure may be based on a thermal expansion of the second heat exchanger.

In yet another aspect, embodiments disclosed herein relate to a heat exchanger system including a rigid framework. A first support structure may hang from the rigid framework via a first set of tethers having one end coupled to the rigid framework and another end coupled to the first support structure. The first set of tethers may be configured to vertically and horizontally move the first support structure. A first heat exchanger may be coupled to the first support structure. A second set of tethers may be connected to the first support structure and extend downward to hang a support beam. A third set of tethers may be connected to the support beam and extend downward to hang a second support structure. The third set of tethers may be configured to vertically and horizontally move the second support structure. A second heat exchanger may be coupled to the second support structure. The vertically and horizontally movement of the first support structure may be based on a thermal expansion of the first heat exchanger. The vertically and horizontally movement of the second support structure may be based on a thermal expansion of the second heat exchanger.

Other aspects and advantages of the invention will be apparent from the following description and the appended claims.

DETAILED DESCRIPTION

Figure 1A:
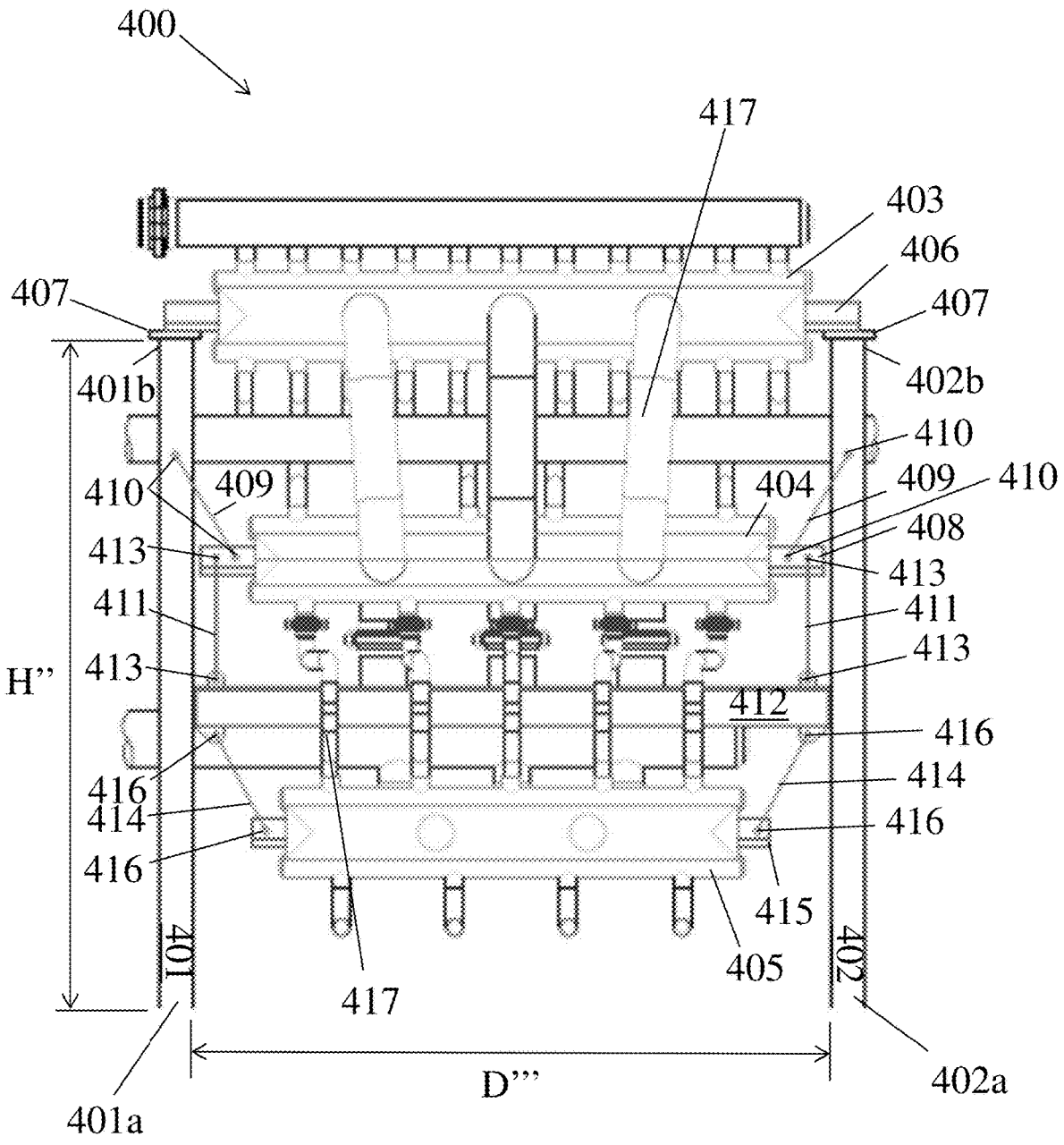
FIG. 1A is a side view of a heat exchanger system in accordance with one or more embodiments of the present disclosure.

Embodiments of the present disclosure are described below in detail with reference to the accompanying figures. Like elements in the various figures may be denoted by like reference numerals for consistency. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description. As used herein, the term "coupled" or "coupled to" or "connected" or "connected to" may indicate establishing either a direct or indirect connection and is not limited to either unless expressly referenced as such. As used herein, fluids may refer to slurries, liquids, gases, and/or mixtures thereof. Wherever possible, like or identical reference numerals are used in the figures to identify common or the same elements. The figures are not necessarily to scale, and certain features and certain views of the figures may be shown exaggerated in scale for purposes of clarification.

In one aspect, embodiments disclosed herein relate to a heat exchanger system for electricity generation, petrochemical plants, waste heat recovery, and other industrial applications. The heat exchanger system may also be interchangeably referred to as a network or assembly of heat exchangers in the present disclosure. Additionally, the heat exchanger system may incorporate a heat exchanger hanger system to minimize expansion stresses arising from thermal expansion of heat exchangers and interconnecting pipework. The heat exchanger hanger system may minimize life cycle cost of heat exchangers that are critical to efficient recuperative thermal energy exchange at high pressure and with high thermal effectiveness. In some embodiments, the heat exchanger hanger system may be used for Supercritical Carbon Dioxide (SCCO2) power cycles, such as an Allam cycle.

Turning to FIG. 1A, FIG. 1A shows an example of a hanger heat exchanger system in accordance with one or more embodiments. The following example is for explanatory purposes only and not intended to limit the scope of the invention. A heat exchanger system 400, as shown in FIG. 1A, may be used in any industrial application such as power generation. In some embodiments, the heat exchanger system 400 may be used in any industrial applications requiring heat exchangers.

In one or more embodiments, the heat exchanger system 400 may have a top-down configuration to allow for easier to installation in the field. A rigid frame may include two columns 401, 402 spaced a distance D''' from each other. The two columns 401, 402 may be made from a metal material and extend upward a height H''. A first end 401*a*, 402*a* of each column 401, 402 may be removably fixed to a floor at a work site. Additionally, the two columns 401, 402 may be rigid to allow for cranes, trailers, or forklifts to lift the heat exchanger system 400 using the two columns 401, 402 as an anchor point. Between the two columns 401, 402, one or more heat exchangers 403, 404, 405 may be provided in the heat exchanger system 400. While it is noted that three heat exchangers 403, 404, 405 are shown in FIG. 1A, this is merely for example purposes only and any number of heat exchangers may be used without departing from the scope of the disclosure. For example, a minor (oxidant stream) section may have two heat exchangers while a major (recycled stream) section may have three heat exchangers. The heat exchangers 403, 404, 405 may be a printed circuit type heat exchanger ("PCHE"), a coil wound type heat exchanger, a micro-tube heat exchanger, a diffusion bonded exchanger using stamped fins in addition to etched plates, plate thin exchangers or any other type heat exchanger. It is further envisioned that the heat exchangers 403, 404, 405 may be replaced with cryogenic or boiler type heat exchangers.

In the configuration of FIG. 1A, in one or more embodiments, the heat exchangers 403, 404, 405 may be arranged in series and arrayed vertically. A first heat exchanger 403 may be at a vertical-most position in the heat exchanger system 400. In a non-limiting example, the first heat exchanger 403 may be coupled to a first support structure 406. The first support structure 406 may be a rigid metal plate coupled at a second end 401*b*, 402*b* of each column 401, 402. Additionally, a plate or cap 407 may be provided on the second end 401*b*, 402*b* of each column 401, 402 for the first support structure 406 to be movably connected thereof. In addition, a portion of the first heat exchanger 403 may extend past the height H'' of the two columns 401, 402.

A second heat exchanger 404 may be positioned below the first heat exchanger 403. The second heat exchanger 404 may be coupled to a second support structure 408. The second support structure 408 may be a rigid metal plate for the second heat exchanger 404 to be coupled thereof. A first set of tethers 409 may hang the second support structure 408 from the two columns 401, 402. The first set of tethers 409 may include two or more tethers. In a non-limiting example, the first set of tethers 409 may be angled at an angle to center the second support structure 408 between the two columns 401, 402. The first set of tethers 409 may be a tension member, a steel rod, chain links, a wire rope, or any type of rod or bar to support a weight and movement of the second heat exchanger 404. Further, ends 410 of the first set of tethers 409 may be a connection point for the first set of tethers 409 on the two rods 401, 402 and the second support structure 408. In some embodiments, the connection point may be a variable position by means of a rack and pinion or a gear driven cam to allow the first set of tethers 409 to be repositioned. The means of the rack and pinion or the gear driven cam, the connection point may be adjusted to allow for active control to directly move the second heat exchanger 404 and a third heat exchanger 405.

From the second support structure 408, a second set of tethers 411 may extend vertically downward to hang a support beam 412. The second set of tethers 411 may include two or more tethers. Ends 413 of the second set of tethers 411 may be a connection point for the second set of tethers 411 on the second support structure 408 and the support beam 412. In some embodiments, the connection point may be variable position by means of a rack and pinion or a gear driven cam to allow the second set of tethers 411 to be repositioned. The means of the rack and pinion or the gear driven cam, the connection point may be adjusted to allow for active control to directly move the third heat exchanger 405. The second set of tethers 411 may be a tension member, a steel rod, chain links, a wire rope, or any type of rod or bar to support a weight and movement of the support beam 412.

In one or more embodiments, the third heat exchanger 405 may be positioned near the first ends 401*a*, 402*a* of the two columns 401, 402 and below the second heat exchanger 404. The third heat exchanger 405 may be coupled to a third support structure 415. The third support structure 415 may be a rigid metal plate for the third heat exchanger 405 to be coupled thereof.

From the support beam 412, a third set of tethers 414 may extend downward to hang the third support structure 415. The third set of tethers 414 may include two or more tethers. In a non-limiting example, the third set of tethers 414 may be angled at an angle to center the third support structure 415 between the two columns 401, 402. In some embodiments, ends 416 of the third set of tethers 414 may be a connection point for the third set of tethers 414 on the support beam 412 and the third support structure 415. In a non-limiting example, the connection point may be variable position by means of a rack and pinion or a gear driven cam to allow the third set of tethers 414 to be repositioned. The means of the rack and pinion or the gear driven cam, the connection point may be adjusted to allow for active control to directly move the third heat exchanger 405. The third set of tethers 414 may be a tension member, a steel rod, chain links, a wire rope, or any type of rod or bar to support a weight and movement of the third heat exchanger 405.

Still referring to FIG. 1A, the first heat exchanger 403 may operate at a highest temperature of the three heat exchangers 403, 404, 405 in the heat exchanger system 400. The third heat exchanger 405 may operate at a coldest temperature of the three heat exchangers 403, 404, 405 in the heat exchanger system 400. The second heat exchanger 404 may operate at a temperature between the temperatures of the first heat exchanger 403 and the third heat exchanger 405. With the first heat exchanger 403 positioned at an uppermost level in the heat exchanger system 400, the first heat exchanger 403 may expand without any movement restrictions such the second heat exchanger 404 and the third heat exchanger 405 may also move. Additionally, since the second heat exchanger 404 and the third heat exchanger 405 operate at lower temperature than the first heat exchanger 403, the second heat exchanger 404 and the third heat exchanger 405 may have a higher allowable stress than the first heat exchanger 403. Therefore, a movement of the the second heat exchanger 404 and the third heat exchanger 405 may be easier to accommodate than a movement of the first heat exchanger 403. Additionally, any thermal expansion of tubing 417 interconnected between the three heat exchangers 403, 405, 405 may be compensated by the sets of tethers 409, 411, 414.

In one or more embodiments, the three heat exchangers 403, 405, 405 are thermally decoupled within the heat exchanger system 400. By having the first heat exchanger 403 coupled to the first support structure 406 at the verticalmost position, the first heat exchanger 403 may thermally expand independently without affecting the second heat exchanger 404 and the third heat exchanger 405. In addition, the first set of tethers 409 may allow for the second heat exchanger 404 to be thermally decoupled from the first heat exchanger 403. As the second heat exchanger 404 thermally expands, the first set of tethers 409 may vertically move the second support structure 408 such that the second heat exchanger 404 is thermally independent from the first heat exchanger 403 and the third heat exchanger 405. Further, by having the support beam 412 hanging from the second set of tethers 411, the support beam 412 may thermally decoupled the second heat exchanger 404 and the third heat exchanger 405 from each other.

Figure 1B:
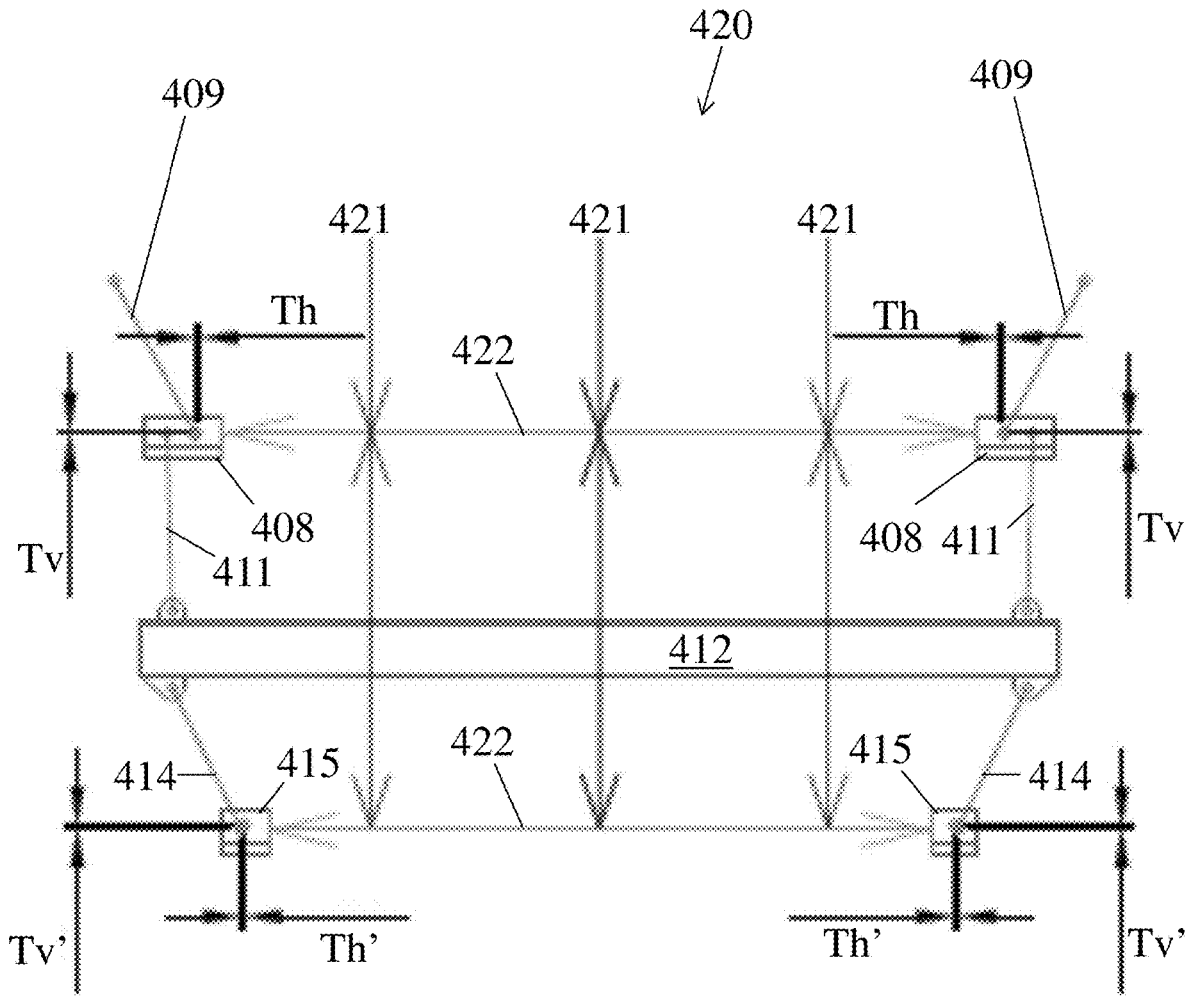
FIG. 1B is a side view of a heat exchanger hanger system of FIG. 1A in accordance with one or more embodiments of the present disclosure.

Now referring to FIG. 1B, FIG. 1B shows an example of a heat exchanger hanger system 420 for the heat exchanger system (see 400) of FIG. 1A accordance with one or more embodiments. The following example is for explanatory purposes only and not intended to limit the scope of the invention. The heat exchanger hanger system 420 may include the first set of tethers 409, the second set of tethers 411, and the third set of tethers 414 connected to the second support structure 408, the support beam 412, and the third support structure 415.

In one or more embodiments, the first heat exchanger (see 403) may be vertically coupled while the second heat exchanger (see 404) and the third heat exchanger (see 405) may be supported by the second support structure 408 and the third support structure 415, respectively. Therefore, the second heat exchanger (see 404) and the third heat exchanger (see 405) may experience vertical displacement as a result of thermal expansion of 403, as well as their own thermal expansion in operation.

As showing in FIG. 1B, arrows 421 represent a vertical displacement of the second heat exchanger (see 404) and the third heat exchanger (see 405). Additionally, arrows 422*a*, 422*b* represent a horizontal thermal expansion of the second heat exchanger (see 404) and the third heat exchanger (see 405). In a non-limiting example, when the second heat exchanger (see 404) is thermally expanding in horizontal direction (Arrow 422*a*), the first set of tethers 409 may move a distance Th in a horizontal plane. This movement distance Th additionally changes an angle of the first set of tethers 409 to then lower the second heat exchanger (see 404) a distance Tv due to the angle change. As the second heat exchanger (see 404) lower the distance Tv, the third heat exchanger (see 405) may also lower the distance Tv. However, when the third heat exchanger (see 405) thermally expands in horizontal direction (Arrow 422*b*), the second set of tethers 411 may move a distance Th' in the horizontal plane to change an angle of the second set of tethers 411. With the angle change of the second set of tethers 411, the third heat exchanger (see 405) moves an additional amount lower such that a distance Tv' vertically moved by the third heat exchanger (see 405) may be the total of the distance Tv and the additional amount lowered.

With the heat exchanger hanger system 420, both horizontal and vertical thermal expansion in various components in the heat exchanger system (see 400) may change or tune angles of the set of tethers 409, 411, 414 to compensate thermal expansion. By compensating for thermal expansion, thermal imbalances from various components cooling and heating at different rates may be managed by the heat exchanger hanger system 420. The heat exchanger hanger system 420 further minimize expansion stresses arising from thermal expansion of heat exchangers and interconnecting pipework in the heat exchanger system (see 400). It is further envisioned that insulation may be used in conjunction with the heat exchanger hanger system 420 to further aid in managing in thermal imbalances. The insulation may be used to prevent heat loss, and to improve system efficiency, which may also have a benefit of helping to manage the thermal balance and result in more accurate predictions of displacements from thermal expansion.

Figure 2:
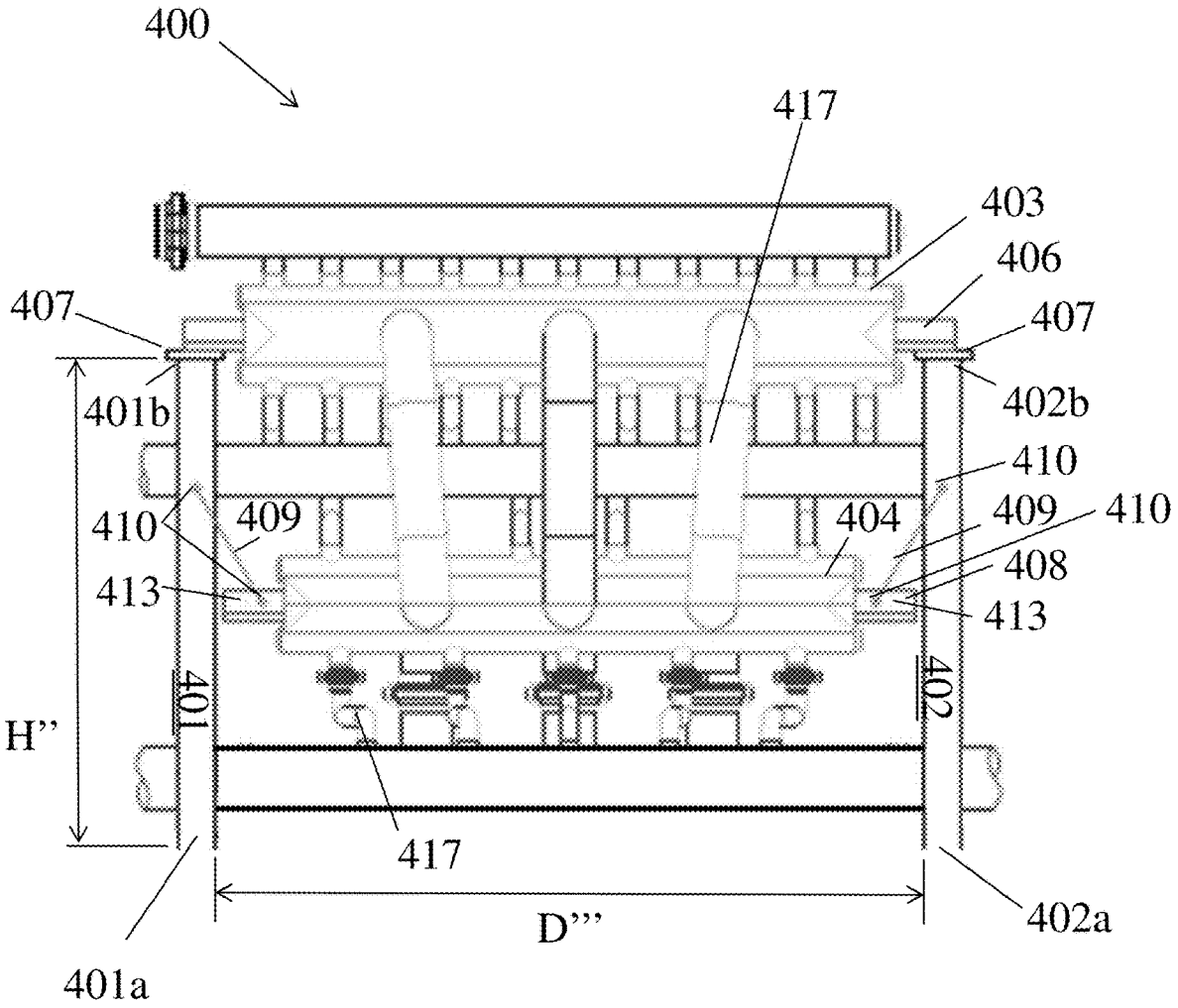
FIGS. 2-5 are side views of a heat exchanger system in accordance with one or more alternative embodiments of FIG. 1A.

Referring now to FIG. 2, another embodiment of a heat exchanger system according to embodiments herein is illustrated, where like numerals represent like parts. The embodiment of FIG. 2 is similar to that of the embodiment of FIG. 1A. However, the heat exchanger system 400 may only have the first heat exchanger 403 and the second heat exchanger 404 without a third heat exchanger (see 405 in FIG. 1A).

Figure 3:
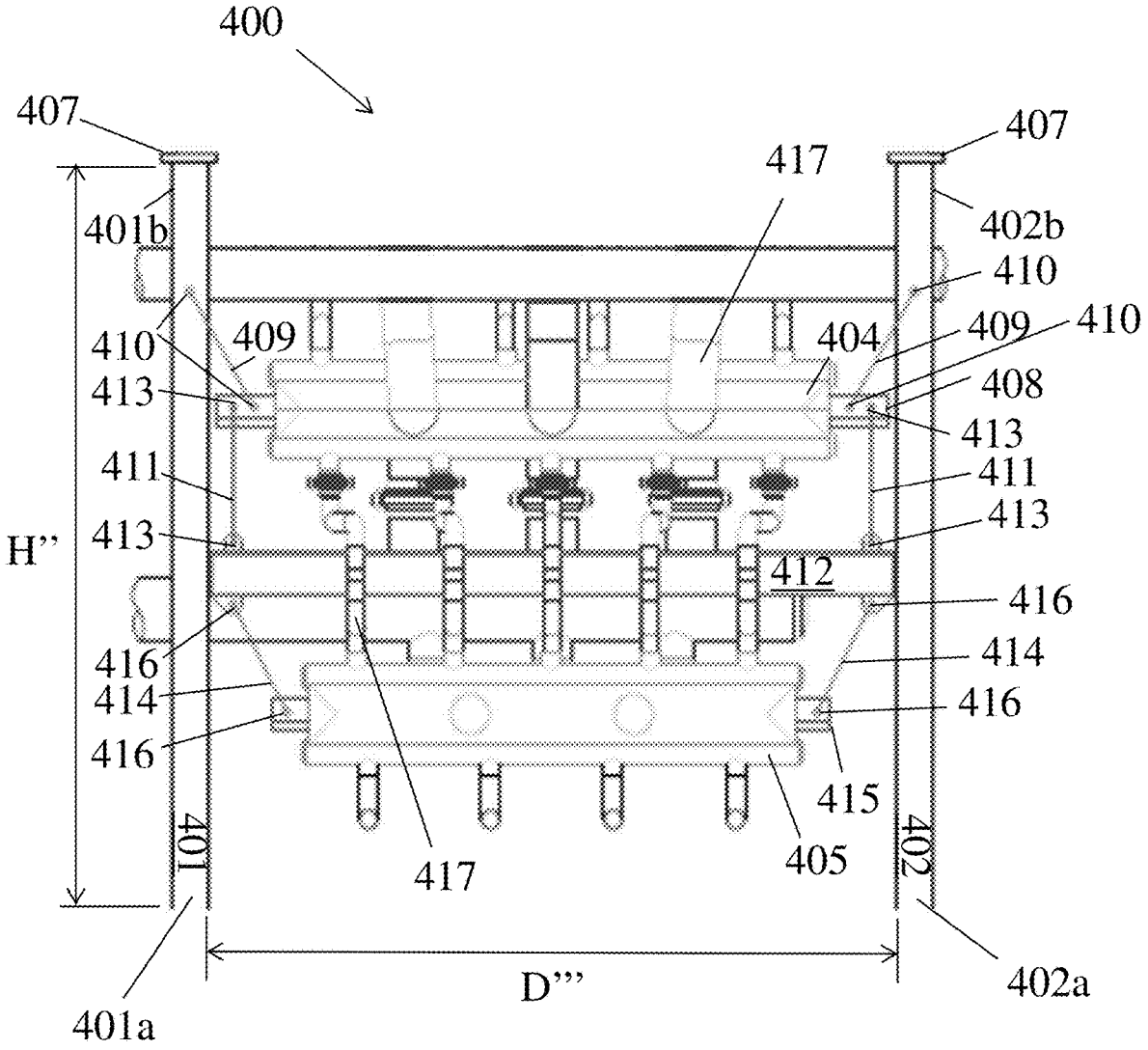

Referring now to FIG. 3, another embodiment of a heat exchanger system according to embodiments herein is illustrated, where like numerals represent like parts. The embodiment of FIG. 3 is similar to that of the embodiment of FIG. 1A. However, the heat exchanger system 400 may only have two heat exchangers both hanging from the heat exchanger hanger system (see 420 in FIG. 1B). In a non-limiting example, the first heat exchanger 403 may be removed such that the second heat exchanger 404 and the third heat exchanger 405, hanging from their respective the set of tethers (409, 414), remain.

Figure 4:
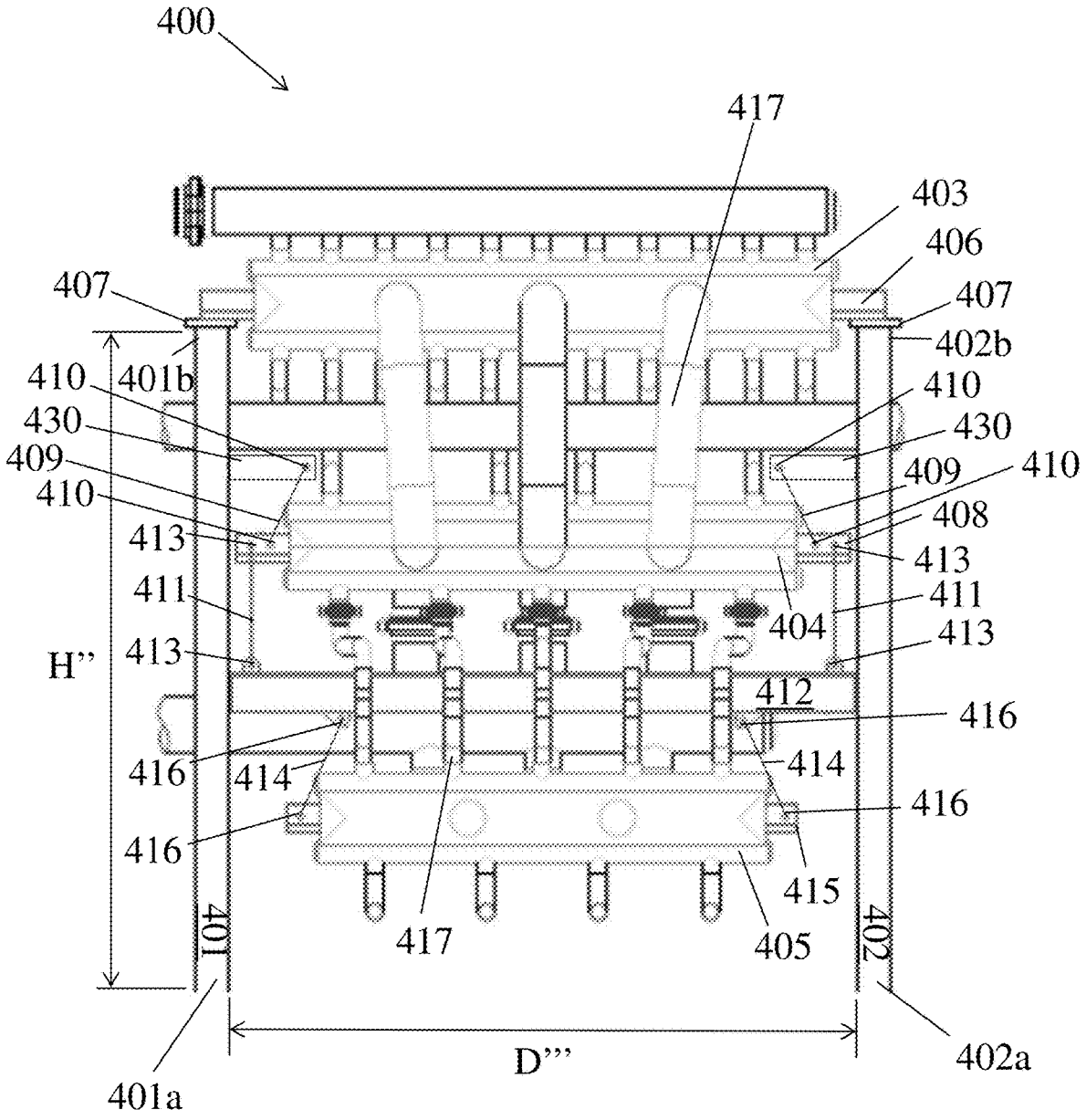

Referring now to FIG. 4, another embodiment of a heat exchanger system according to embodiments herein is illustrated, where like numerals represent like parts. The embodiment of FIG. 4 is similar to that of the embodiment of FIG. 1A. However, instead of the first set of tethers 409 and the third set of tethers 414 (see FIG. 1A) being angled outwardly, the first set of tethers 409 may be angled inward. In a non-limiting example, one or more protrusions 430 may extend inward from the rigid frame (the two columns 401, 402) such that one end 410 of the first set of tethers 409 may be a connection point on the one or more protrusions 430. By angling the first set of tethers 409 inward, the thermal expansion of the second heat exchanger 404 may cause the second support structure 408 to raise vertically upward. Additionally, the third set of tethers 414 may also be angled inward to cause the third support structure 415 to raise vertically upward based on the thermal expansion of the third heat exchanger 405.

Figure 5:
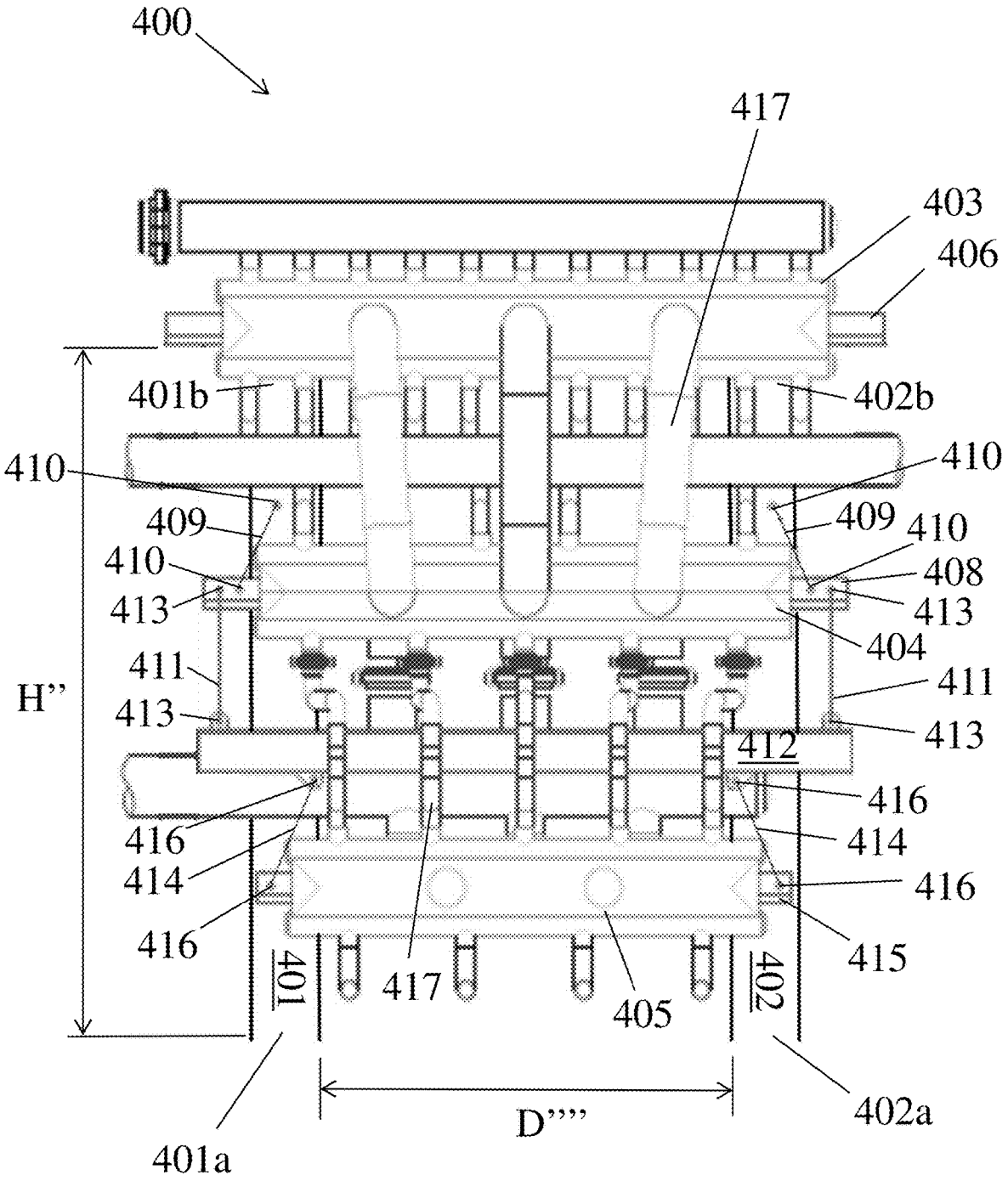

Referring now to FIG. 5, another embodiment of a heat exchanger system according to embodiments herein is illustrated, where like numerals represent like parts. The embodiment of FIG. 5 is similar to that of the embodiment of FIG. 1A. However, the two columns 401, 402 of the rigid frame may be moved closer together such that a distance D"" between the two columns 401, 402 is less than the distance D'''. By moving the two columns 401, 402 closer together, the first set of tethers 409 may be angled inward. By angling the first set of tethers 409 inward, the thermal expansion of the second heat exchanger 404 may cause the second support structure 408 to raise vertically upward. Additionally, the third set of tethers 414 may also be angled inward to cause the third support structure 415 to raise vertically upward the based on the thermal expansion of the third heat exchanger 405.

As described in FIGS. 1A-5, the heat exchanger systems 400 connects a series of independently moving parts. The heat exchanger systems 400 described herein allows for the series of independently moving parts to be connected while accounting for the independent movement and providing advantages in the overall system, including low stress on the heat exchangers (404, 405) to piping nozzles (417), for example. For the heat exchanger systems 400 in FIGS. 1A-5, the heat exchanger hanger system (420) may have a system of tethers 409, 411, 414 may be configured to adjust a position (i.e., neutral, raising, lowering) of the lower heat exchangers (404, 405). In one or more embodiments, the configuration of the system of tethers 409, 411, 414 may be based on an expected thermal expansion or contraction of the components during startup, operation, and shut down of the heat exchanger systems 400. In addition, an angle of the tethers may be selected based on the expected thermal expansion or contraction. Further, each angle of the tethers may be independently tuned.

In the heat exchanger systems 400, the support bar 412 may enhance the independent movement of the heat exchangers (404, 405). With inclusion of the support bar 412, the second heat exchanger 404 does not impact an ability of the third heat exchanger 405 to independently move. Thus, the support bar 412 provides various degrees of freedom to accommodate pipe movement and expansion within the heat exchanger systems 400. The support bar 412 allows one to isolate and use expansion methods to advantageously decouple the thermal expansion of each heat exchangers to minimize load on nozzles and may allow shorter expansion piping lengths. By minimizing the load and allowing shorter piping, an overall weight of unit may be reduced. Additionally, stresses associated with the heat exchanger hanger system (420), allows various piping to be decreased in length and to allow the overall system to become more compact.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A heat exchanger system, comprising:

a framework;

a first heat exchanger coupled to a first support structure on a top of the framework;

a second heat exchanger positioned below the first heat exchanger, wherein the second heat exchanger is coupled to a second support structure, the second support structure hanging from the framework via a first set of tethers, wherein the first set of tethers is configured to vertically and horizontally move the second support structure;

a second set of tethers connected to the second support structure and extend downward to hang a support beam;

a third set of tethers connected to the support beam and extend downward to hang a third support structure, wherein the third set of tethers is configured to vertically and horizontally move the third support structure; and a third heat exchanger coupled to the third support structure, wherein the vertically and horizontally movement of the second support structure is based on a thermal expansion of the second heat exchanger, and wherein the vertically and horizontally movement of the third support structure is based on a thermal expansion of the third heat exchanger.

2. The heat exchanger system of claim 1, wherein the first heat exchanger is configured to operate at a higher temperature than the second heat exchanger, and the second heat exchanger is configured to operate at a higher temperature than the third heat exchanger.

3. The heat exchanger system of claim 1, wherein the first set of tethers, the second set of tethers, and the third set of tethers are selected from a structural tension member, a steel rod, chain links, or a wire rope.

4. The heat exchanger system of claim 1, wherein the first set of tethers and the third set of tethers are angled.

5. The heat exchanger system of claim 1, wherein the framework comprises two columns spaced a distance from each other.

6. The heat exchanger system of claim 5, wherein the first heat exchanger, the second heat exchanger, and the third heat exchanger are between the two columns.

7. The heat exchanger system of claim 5, wherein a first end of each of the two columns is removably fixed to a floor.

8. The heat exchanger system of claim 7, wherein the first support structure is movably coupled to a second end of each of the two columns distal to the first end.

9. The heat exchanger system of claim 1, further comprising one or more protrusions extending from the framework, wherein an end of the first set of tethers is connected to the one or more protrusions.

10. The heat exchanger system of claim 1, wherein the first heat exchanger is thermally independent of the second heat exchanger, and the second heat exchanger is thermally independent of the third heat exchanger.

11. A heat exchanger system, comprising:

a framework;

a first heat exchanger coupled to a first support structure on a top of the framework;

a second heat exchanger positioned below the first heat exchanger, wherein the second heat exchanger is coupled to a second support structure, the second support structure hanging from the framework via a first set of tethers; and tubing interconnected between the first heat exchanger and the second heat exchanger, wherein the first set of tethers are positioned at an angle to the framework that varies in response to a thermal expansion or contraction of the second heat exchanger to vertically and horizontally move the second support structure, wherein vertical and horizontal movement of the second support structure is based on the thermal expansion or contraction of the second heat exchanger.

12. The heat exchanger system of claim 11, wherein the first heat exchanger is thermally independent of the second heat exchanger.

13. The heat exchanger system of claim 11, wherein the angle of the first set of tethers relative to columns of the framework varies between 0 degrees and 90 degrees.

14. The heat exchanger system of claim 13, wherein first ends of the first set of tethers are coupled to columns of the framework and second ends of the first set of tethers are coupled to the second support structure.

15. The heat exchanger system of claim 11, wherein the first heat exchanger is configured to operate at a higher temperature than the second heat exchanger.

16. The heat exchanger system of claim 11, wherein the framework includes a plurality of columns with the first support structure being a horizontal beam coupled to the plurality of columns, and wherein the first set of tethers are coupled to the plurality of columns and positioned at an angle relative to the plurality of columns to suspend the second support structure from the plurality of columns with the second support structure being horizontal.

17. The heat exchanger system of claim 16, wherein the first set of tethers are coupled to the plurality of columns below the coupling between the first support structure and the plurality of columns.

18. The heat exchanger of claim 11, wherein the first set of tethers are coupled to the framework at a first location that is below a second location where the first support structure is coupled to the framework.

19. The heat exchanger of claim 11, wherein vertical movement of the second support structure corresponds to vertical thermal expansion of the thermal expansion tube.

20. A heat exchanger system, comprising:

a framework;

a first support structure hanging from the framework via a first set of tethers having one end coupled to the framework and another end coupled to the first support structure, wherein the first set of tethers is configured to vertically and horizontally move the first support structure;

a first heat exchanger coupled to the first support structure;

a second set of tethers connected to the first support structure and extend downward to hang a support beam;

a third set of tethers connected to the support beam and extend downward to hang a second support structure, wherein the third set of tethers is configured to vertically and horizontally move the second support structure; and a second heat exchanger coupled to the second support structure, wherein the vertically and horizontally movement of the first support structure is based on a thermal expansion of the first heat exchanger, and wherein the vertically and horizontally movement of the second support structure is based on a thermal expansion of the second heat exchanger.

21. The heat exchanger system of claim 20, wherein the first heat exchanger is thermally independent of the second heat exchanger.

22. The heat exchanger system of claim 20, wherein the first set of tethers and the third set of tethers are angled.

23. The heat exchanger system of claim 20, wherein the first heat exchanger is configured to operate at a higher temperature than the second heat exchanger.

* * * * *